US006066000A

United States Patent [19]

Masumoto et al.

[11] Patent Number: 6,066,000

[45] Date of Patent: May 23, 2000

[54] TWO-PIECE ELECTRICAL CONNECTOR HAVING A CABLE CONNECTOR WITH A SINGLE METALLIC SHELL HOLDING A CABLE FIXTURE

[75] Inventors: Toshio Masumoto, Musashimurayama; Nobukazu Kato, Fussa, both of Japan

[73] Assignee: Japan Aviation Electronics Industry Limited, Tokyo, Japan

[21] Appl. No.: 09/050,775

[22] Filed: Mar. 30, 1998

[30] Foreign Application Priority Data

Mar. 31, 1997 [JP] Japan ..... 9-081129

[51] Int. Cl.[7] ..... H01K 13/648

[52] U.S. Cl. ..... 439/607; 439/497

[58] Field of Search ..... 439/325, 327, 439/329, 345, 347, 783, 836, 837, 863, 493, 494, 495, 496, 497, 499, 607, 608, 609, 610, 492

[56] References Cited

FOREIGN PATENT DOCUMENTS 9-232039 5/1997 Japan .

*Primary Examiner*—Paula Bradley
*Assistant Examiner*—Ross Gushi
*Attorney, Agent, or Firm*—Laff, Whitesel & Saret, Ltd.; J. Warren Whitesel

[57] ABSTRACT

Fixing a flat cable (7) to a cable connector member (3) of a two-piece electrical connector (1) is performed by a slider (10) inserted together with one end portion of the flat cable (7) into a connector housing (20). A metallic shall (13) fixedly supports the slider (10) therein and is slidably fitted on the connector housing (20) for providing the electromagnetic shielding. Insertion and removal of the slider (10) for the connector housing (20) are performed by sliding operation of the metallic shell (13) on the connector housing (20).

5 Claims, 10 Drawing Sheets

TWO-PIECE ELECTRICAL CONNECTOR HAVING A CABLE CONNECTOR WITH A SINGLE METALLIC SHELL HOLDING A CABLE FIXTURE

BACKGROUND OF THE INVENTION

This invention relates to a two-piece electrical connector for connecting a flat cable to a connection object and, in particular, to such a connector having metallic shells for electromagnetic shielding.

A two-piece electrical connector of the type described is used in, for example, notebook type computers. Such a two-piece electrical connector comprises a cable connector member mounted on a flat cable and a mating connector member mounted on a connection object such as a printed circuit board. The cable connector member is mated with the mating connector member to establish the connection between the flat cable and the printed circuit board.

As the flat cable, there are known a flexible flat cable (FFC), a flexible printed circuit (FPC) and the like. The flat cable generally comprises an insulator sheet or film having two laminated layers in which a plurality of signal conductors are embedded for transferring electric signals. A ground pattern is generally coated on at least one outer surface of the insulator film as an electro-magnetic shielding in order to suppress the electromagnetic interference generating noise.

One of the present joint inventors made an invention of such a two-piece connector described above together with a different joint inventor and filed a Japanese patent application on Feb. 21, 1996 (Application No. 33975/96) in the name of the same assignee (Japan Aviation Electronics Industry, Limited) which was published with a laid open number JP-A-9 232039 on Sep. 5, 1997 which is later than the priority date (Mar. 31, 1997) of the present application.

The two-piece electrical connector proposed in the prior Japanese patent application (which will be referred to as a prior connector) has metallic shells mounted on the outer surface thereof for protecting the connector from the noise. A cable connector member in the prior connector is provided with a cable fixture for fixing an end of the flat cable to the cable connector member itself for establishing electrical and mechanical connection of the flat cable and the cable connector member. The cable fixture is rotatably mounted on a connector housing of the cable connector member. That is, when the cable fixture is positioned at a first position or an open position, the one end of the flat cable is loosely insertable in the cable connector member. When the cable fixture is angularly rotated to a second position or a fixing position, the one end of the flat cable is pressed onto contact terminal portions in the cable connector member by the cable fixture so that the flat cable is mechanically and electrically connected to the cable connector member. The cable connector has a metallic shell covering an outer surface of the connector housing and another metallic shell covering the cable fixture.

In the prior connector, two pieces of different metallic shells are required for the cable connector member and another different metallic shell is required to a mating connector. Thus, metallic shells of three different shapes must be prepared and assembled to the two different connector members. This results in a high cost, complicate assembling operation, and difficulty of management and quality control of parts.

Further, in the prior connector, the cable fixture is rotatably mounted on the connector housing. Therefore, the connector requires an increased mounting space in order to allow the rotation of the cable fixture. This results in difficulty of high density disposition of electric parts including the prior connector.

SUMMARY OF THE INVENTION

It is an object of this invention to provide a two-piece electrical connector comprising a cable connector member and a mating connector member both having individual single metallic shells without degradation of electromagnetic shielding although the cable connector member is provided with a cable fixture. Therefore, the two-piece connector of this invention is easy in assembling operation and management and quality control of parts, simple in construction and economical in cost.

It is another object of this invention to provide a two-piece electrical connector which can decrease a space for mounting the connector.

According to this invention, there is provided with a two-piece electrical connector comprising a cable connector member to be removably mounted on one end portion of a flat cable to establish mechanical and electrical connection with the flat cable and a mating connector member to be electrically and mechanically connected to a connection object and to be mated with the cable connector member for establishing an electrical connection between the flat cable and the connection object, the flat cable comprising a plurality of signal conductors embedded in an electrical insulator film and partially exposed at one end portion thereof in one surface of the insulator film. The cable connector member comprises: a first insulator having a rear opening for receiving the one end of the flat cable; a plurality of first contact elements fixed in the first insulator, the first contact elements individually having first contact portions and first terminal portions disposed in the rear opening; an insulator slider slidably fitted into the rear opening to press the one end portion of the flat cable onto the first terminal portions when being inserted together with the one end portion of the flat cable into the rear opening so that the first terminal portions come into press contact with the signal conductors, respectively; and a first metallic shell of a generally box shape having a front open end and fixedly supporting the insulator slider therein, the metallic shell being fitted onto the first insulator and slidable on the first insulator upon inserting the insulator slider into the rear opening. The mating connector member comprises: a second insulator; a plurality of second contact elements fixedly supported in the second insulator and individually having second contact portions exposed from the second insulator, the second contact portions coming into contact with the first contact portions when the mating connector member is mated with the cable contact member, the second contact elements individually having second terminal portions to be connected to the connection object; and a second metallic shell mounted on and covering an outer surface of the second insulator, the second metallic shell being partially fitted onto the cable connector member to come into contact with the first metallic shell when the mating connector member is mated with the cable connector member.

In a case where the flat cable further has a ground pattern formed on the opposite surface of the insulator film, the first metallic shell is provided with an engaging portion for engaging with the ground pattern of the flat cable.

In one aspect, the insulator slider comprises an insertion portion to be inserted within the rear opening and a support portion fixedly supported by the first metallic shell, the insulator slider having a flat surface continuous from the insertion portion to the support portion, the first metallic shell having an inner flange portion as the engaging portion extending inwardly therein and on the flat surface of the insulator slider, the first metallic shell having a rear aperture adjacent to the inner flange portion for receiving the one end portion of the flat cable with the ground pattern engaging with the inner flange portion, when the insulator slider is inserted into the rear opening together with the flat cable.

DESCRIPTION OF THE PREFERRED EMBODIMENTS

Figure 1:
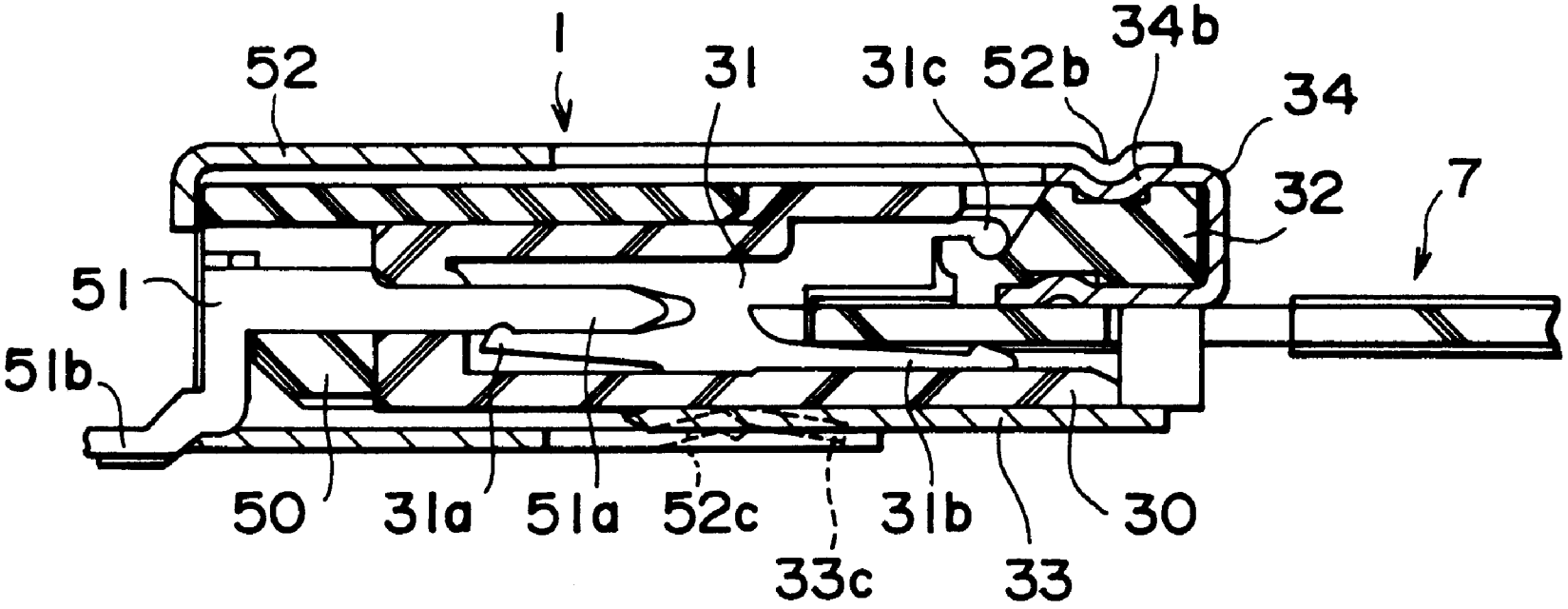
FIG. 1 PRIOR ART
FIG. 1 is a sectional view of a prior connector in a mated condition.

Prior to description of preferred embodiments of this invention, description will be made as regards the prior connector disclosed in JP-A-9 232039 raised in the preamble, with reference to FIGS. 1 to 6.

The prior connector 1 comprises a cable connector member 3 and a mating connector member 5. The cable connector member 3 is connected to a flat cable 7 and the mating connector member 5 is usually surface-mounted on a circuit board. Therefore, the cable connector member and the mating connector member will be referred to as "cable side connector" and "board side connector", respectively, hereinafter.

The cable side connector 3 comprises a cable side insulator 30, a plurality of cable side contact elements 31, a cable fixture 32, and two cable side metallic shells 33 and 34.

The cable side insulator 30 has an opening 30*a* in its rear end. Through the rear opening 30*a*, one end portion of the flat cable 7 is inserted into the cable side insulator 30.

The plurality of cable side contact elements 31 are fixedly held in the cable side insulator 30 and arranged in parallel with each other. Each of the cable side contact elements 31 comprises a contact portion 31*a* of a socket type, a terminal portion 31*b*, and a pivot portion 31*c*.

The contact portion 31*a* is disposed in a front space formed in the cable side insulator 30 and brought into contact with corresponding one of board side contact elements 51 of the board side connector 5 described hereinafter. The terminal portion 31*b* is disposed in a rear space continuous from the rear opening 30*a* and brought into contact with corresponding one of signal conductors 70 exposed at one end portion of the flat cable 7. The pivot portion 31*c* pivotally supports the cable fixture 32 so that the cable fixture is rotatable about the pivot portion 31*c*.

The cable fixture 32 is made of an insulating material and formed with a recessed portion 32*a* at its front end portion. The recessed portion 32*a* engages with the pivot portions 31*c* of the cable side contact elements 31. By means of the engagement therebetween, the cable fixture 32 is, as described above, rotatable about the pivot portions 31*c*. Through the rotating motion, the cable fixture 32 opens and closes an upper portion of the rear opening 30*a* of the cable side insulator 30.

Figure 2:
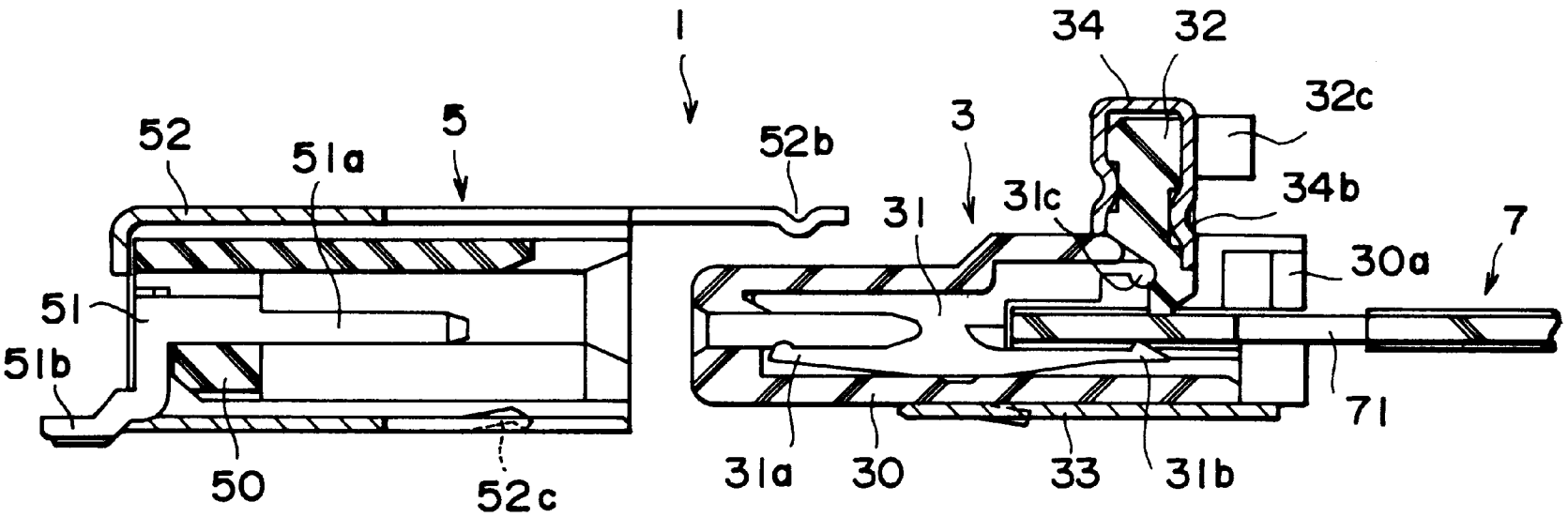
FIG. 2 PRIOR ART
FIG. 2 is a sectional view of the connector of FIG. 1 in a state just before mating a cable connector member to a mating connector member and before connecting the cable connector member to a flat cable.
Figure 3:
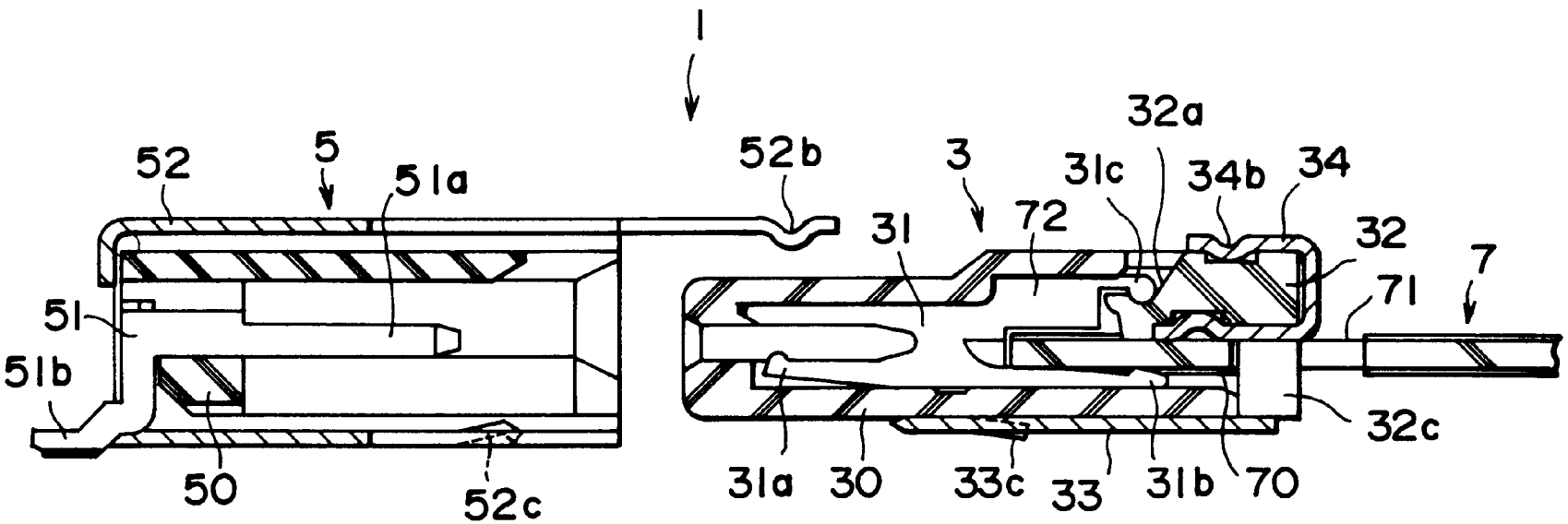
FIG. 3 PRIOR ART
FIG. 3 is a sectional view of the connector of FIG. 1 showing a state after the cable connector member is connected to the flat cable but before the cable connector is mated with the mating connector.
Figure 4:
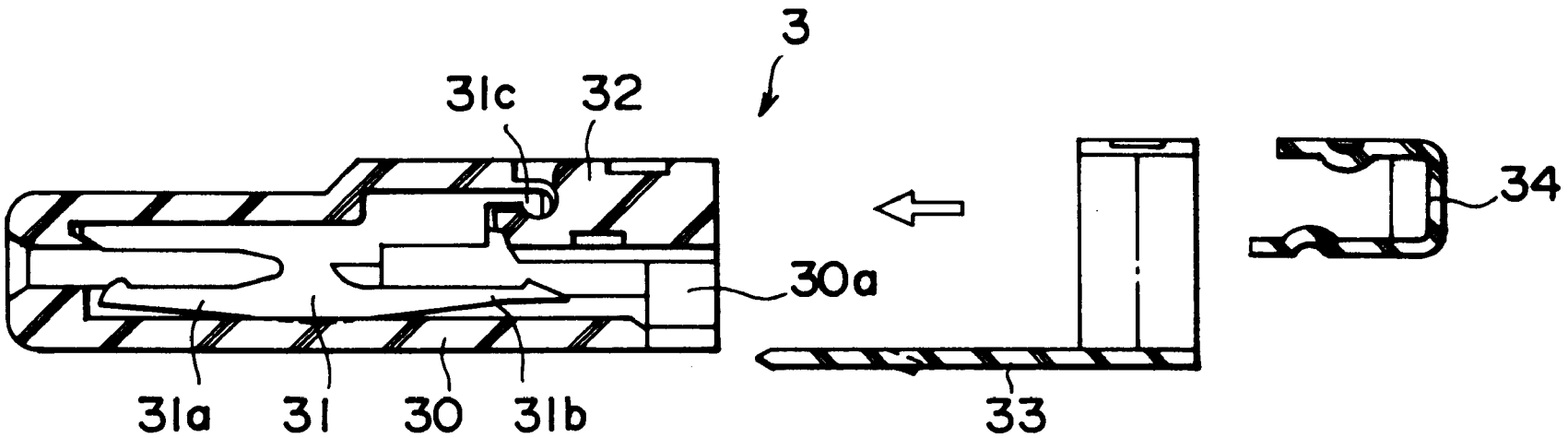
FIG. 4 PRIOR ART
FIG. 4 is a sectional view of the cable connector member in FIGS. 1 through 3 with two shells disassembled.
Figure 5:
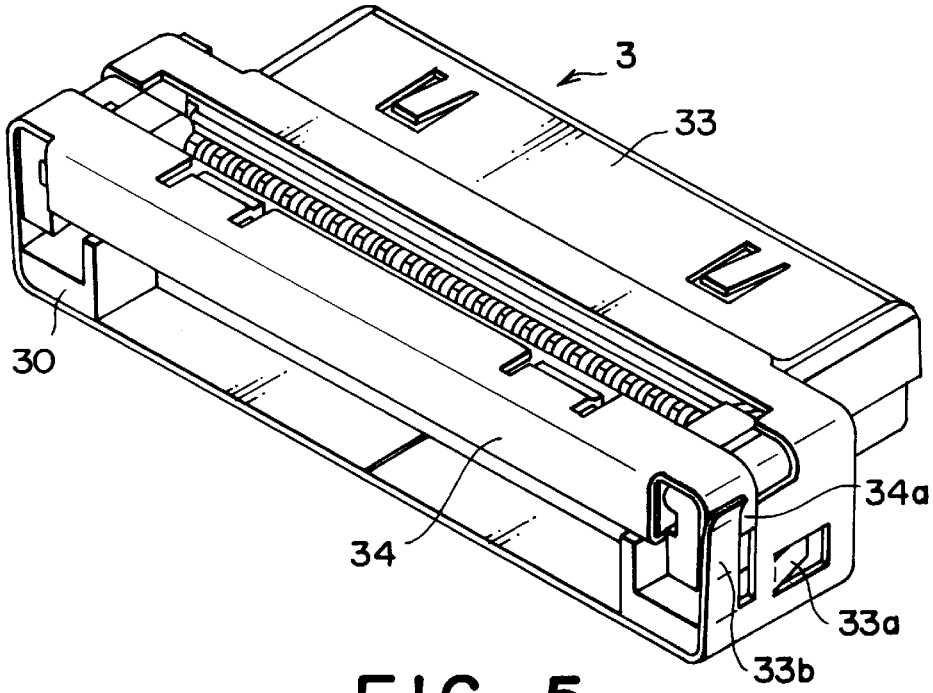
FIG. 5 PRIOR ART
FIG. 5 is a perspective view of the cable connector member in FIGS. 1 through 4.

When the cable fixture 32 is positioned at the open position as shown in FIG. 2, the one end of the flat cable 7 can be inserted into the rear space through the rear opening 30*a*. Then, when the cable fixture 32 closes the upper portion of the rear opening 30*a* as shown in FIGS. 1 and 3, the cable fixture 32 presses the one end portion of the flat cable 7 against the terminal portions 31*b* of cable side contacts 31. Thus, the signal conductors 70 (FIG. 6) are brought into press contact with the terminal portions 31*b*.

The cable fixture 32 is formed at both sides thereof with protrudent portions 32*c*. When the cable fixture 32 closes the upper portion of the opening 30*a*, the protrudent portions 32*c* are fitted into notches 71 (FIG. 6) formed at both sides of the one end portion of the flat cable 7. In this state, even if the flat cable 7 is pulled, the cable fixture 32 is not opened so that the flat cable 7 can not be pulled out of the cable side insulator 30.

Instead of the notches 71, the flat cable 7 may be formed with holes for receiving therein the protrudent portions 32*c*.

The metallic shell 33 is electrically conductive and is fitted onto and covers the cable side insulator 30. The metallic shell 33 is formed with engaging portions 33*a* at both side walls which engage with the cable side insulator 30. Further, the both side walls of the metallic shell 33 have contact portions 33*b* for engagement with the other metallic shell 34.

The other metallic shell 34 is electrically conductive and is fixed onto and covers the cable fixture 32. Therefore, the other metallic shell 34 will be referred to as "fixture shell". The fixture shell 34 is formed at both sides thereof with contact portions 34*a* for engagement with the contact portions 33*b* of the metallic shell 33. When the cable fixture 32 is positioned at the close position, the contact portions 34*a* of the fixture shell 34 are in contact with the contact portions 33*b* of the metallic shell 33. Further, a bottom of the fixture shell 34 engages with a ground pattern 72 (FIG. 6) of the flat cable 7 formed at a side thereof opposite to the signal conductors 70 exposed.

The assembling procedure of the cable side connector 3 is as follows: First, the cable side contact elements 31 are press-fitted in the cable side insulator 30. Then, the cable fixture 32 is covered with the fixture shell 34. Then, the recessed portion 32*a* of the cable fixture 32 is fitted onto the pivot portions 31*c* of the cable side contact elements 31 in the state where the recessed portion 32*a* is located at the lower end of the cable fixture 32. Then, the cable side insulator 30 is fitted into and therefore covered with the metallic shell 33. Then, the one end portion of the flat cable 7 is inserted into the rear space in the cable side insulator 30 via the rear opening 30*a*. Thereafter, while rotating the cable fixture 32 toward the flat cable 7, the protrudent portions 32*c* of the cable fixture 32 are fitted into the notches 71 of the flat cable 7. As a result, by means of the cable fixture 32, the signal conductors 70 exposed at the one end portion of the flat cable 7 are pressed onto the terminal portions 31*b* of the cable side contact elements 31, and the fixture shell 34 is pressed onto the ground pattern 72 of the flat cable 7.

Now, the board side connector 5 will be explained. The board side connector 5 comprises a board side insulator 50, a plurality of board side contact elements 51 and a metallic shell 52 which will be referred to as a "board side shell". The board side connector 5 is mounted on a printed circuit board (not shown).

The board side insulator 50 has an essentially rectangular parallelepiped shape. For connection to the cable side contact elements 31 of the cable side connector 3, the board side contact elements 51 are fixedly held in the board side insulator 50 and arranged in parallel with each other so as to correspond to the cable side contact elements 31. Each of the board side contact elements 51 comprises a contact portion 51*a* of a pin type and a terminal portion 51*b*. The contact portion 51*a* is brought into contact with the contact portion 31*a* of the cable side contact element 31 when the board side connector 5 is mated with the cable side connector 3. The terminal portion 51*b* is soldered to corresponding one of signal conductors of the circuit board (not shown) when the board side connector 5 is surface-mounted on the circuit board.

The board side shell 52 is electrically conductive and is fitted onto and covers the board side insulator 50. The board side shell 52 has an extension which extends from the board side insulator to surround the contact portions 51*a* projected from the board side insulator 50. In the extension of the board side shell 52, the front end portion of the cable side connector 3 is fitted to mate the cable side connector 3 with the board side connector 5, and the board side shell 52 is brought into contact with the metallic shell 33. Accordingly, when the cable side connector 3 and the board side connector 5 are connected to each other, the metallic shells 33, 34, and 52 are grounded so that the electromagnetic shielding effect is achieved.

In the two-piece electrical connector 1, the metallic shell 33 covers a rear end portion and a bottom of the cable side insulator 30 while it does not cover an upper surface of the cable side insulator 30. On the other hand, the board side shell 52 has an upper surface which extends to cover the upper surface of the cable side insulator 30 when the cable side connector 3 and the board side connector 5 are connected to each other. The board side shell 52 is formed with contact portions 52*b* and 52*c* at one end portions of its upper and bottom surfaces. On the other hand, the metallic shell 33 is formed at a bottom thereof with a contact portion 33*c* for engagement with the contact portion 52*c* of the board side shell 52 upon mating the cable side connector 3 with the board side connector 5. Similarly, the fixture shell 34 is formed with a contact portion 34*b* for engagement with the contact portion 52*b* of the board side shell 52 upon mating the cable side connector 3 with the board side connector 5. Further, the fixture shell 34 is in contact with the metallic shell 33 at its both sides.

The prior connector has problems described in the preamble.

Now, an embodiment of the present invention will be described with reference to FIGS. 7 to 11C.

Figure 7:
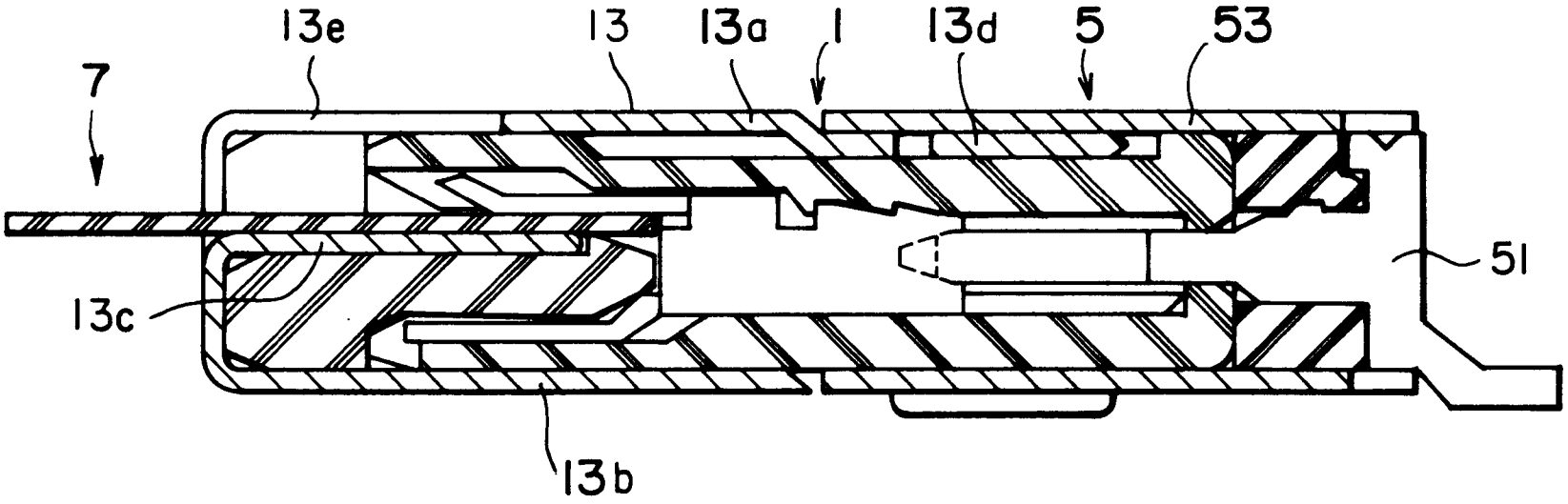
FIG. 7 is a sectional view of a two-piece electrical connector according to an embodiment of this invention.
Figure 8:
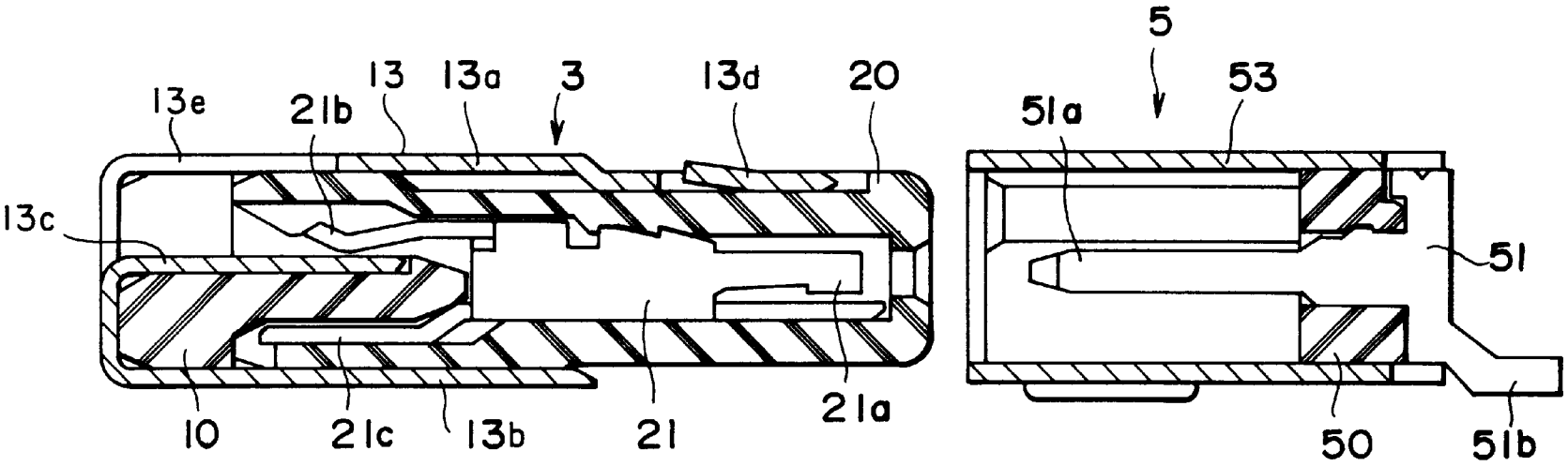
FIG. 8 is a sectional view of the connector of FIG. 7 showing a state before a cable connector member is mated with a mating connector member.

As shown in FIGS. 7 and 8, a two-piece electrical connector 1 comprises a cable side connector 3 as a cable connector member and a board side connector 5 as a mating connector member.

Figure 9:
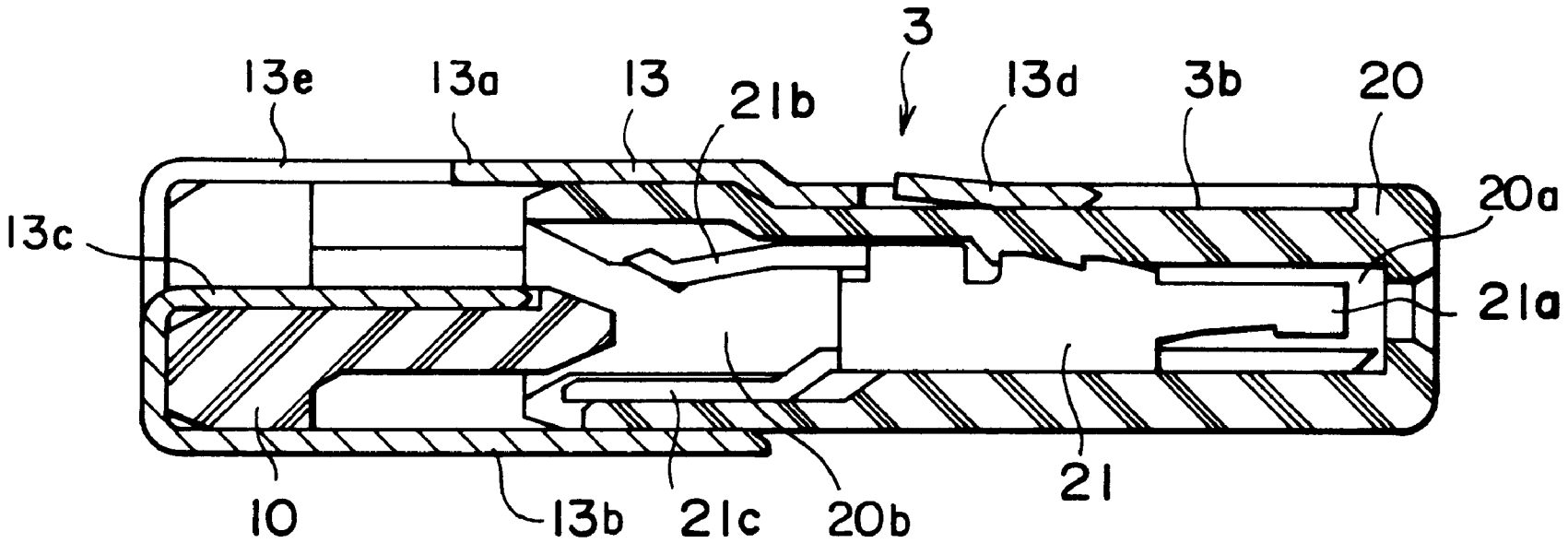
FIG. 9 is a sectional view of the cable connector member in FIGS. 7 and 8 in a state just before the cable connector member is connected to the flat cable.

As shown in FIG. 9, the cable side connector 3 comprises a cable side insulator 20 as a connector housing, a cable side shell 13, a plurality of cable side contact elements 21, and a slider 10 as a cable fixture.

The cable side insulator 20 is made of an insulating material such as synthetic resin. The cable side insulator 20 is formed with a plurality of contact receiving holes 20*a* at its front end portion and a rear opening 20*b* at its rear end portion. The contact receiving holes 20*a* receive a plurality of contact portions 51*a* of board side contacts 51 later-described. The rear opening 20*b* receives an end portion of a flat cable 7 later-described.

The cable side shell 13 is made of an electro-conductive metallic plate and is formed in a box shape with a front open end to cover a circumferential surface and a rear end surface of the cable side insulator 20. That is, the cable side shell 13 comprises an upper plate 13*a* frontwardly extending from a rear end wall or a bottom wall of the front open box-shape of the cable side shell, and a lower plate 13*b* also frontwardly extending from the rear end wall. The upper plate 13*a* is formed with an elastically deformable end portion 13*d*. The cable side shell 13 is further formed with an aperture 13*e* in a rear upper end potion thereof and an inner flange 13*c* frontwardly and inwardly extending from the rear end wall adjacent to the rear aperture 13*e*. Actually, the inner flange 13*c* is formed by cutting and bending of the upper plate 13*a* and the end wall to simultaneously form the rear aperture 13*e*. The inner flange 13*c* is generally parallel to the upper plate 13*a* and the lower plate 13*b* but much shorter than them. The rear aperture 13*e* is for receiving the flat cable 7 inserted into the cable side connector 3 for connection.

The cable side shell 13 is fitted onto the cable side insulator 20 and can slide rearwardly and frontwardly on the circumferential surface of the cable side insulator 20 between a first position (see FIG. 10) and a second position (see FIG. 9) by guiding function between an inner surface of the cable side shell 13 and the circumferential outer surface of the cable side insulator 20 which are in sliding contact with each other. The cable side shell 13 covers the most part of the circumferential surface of the cable side insulator 20 in the first position.

Each of the cable side contact elements 21 is made of an electro-conductive metallic plate. Each of the cable side contact elements 21 has a contact portion 21*a* of a socket type at a front end thereof, a terminal portion or a cable contact portion 21*b* for contacting the flat cable 7, and a slider engaging portion 21*c* at a rear end thereof. The cable contact portion 21*b* and the slider engaging portion 21*c* face each other with a gap left therebetween. The plurality of cable side contact elements 21 are arranged at a predetermined pitch in parallel with each other in the cable side insulator 20. The contact portion 21*a* is disposed in the contact receiving hole 20*a*. The cable contact portion 21*b* and the slider engaging portion 21*c* are disposed in the rear opening 20*b* of the cable side insulator 20.

The slider 10 is made of an insulating material such as synthetic resin. A front end portion of the slider 10 can be inserted, as an insertion portion, into the rear opening 20*b* of the cable side insulator 20. And a rear thick portion of the slider 10 is fixed between the inner flange 13*c* and the lower plate 13*b* of the cable side shell 13 and is thereby supported, as a support portion, by the cable side shell 13. In detail, the slider 10 has a flat surface continuous from the front end portion to the rear thick portion. The inner flange 20*c* of the shell 20 extends on the flat surface.

The slider 10 moves together with the cable side shell 13 as one body when the cable side shell 13 slides on the cable side insulator 20 between the first position and the second position. In transition from a state shown in FIG. 9 to another state shown in FIG. 8, the front end portion of the slider 10 is inserted between the cable contact portion 21*b* and the slider engaging portion 21*c* in the rear opening 20*b* of the cable side insulator 20.

Figure 6:
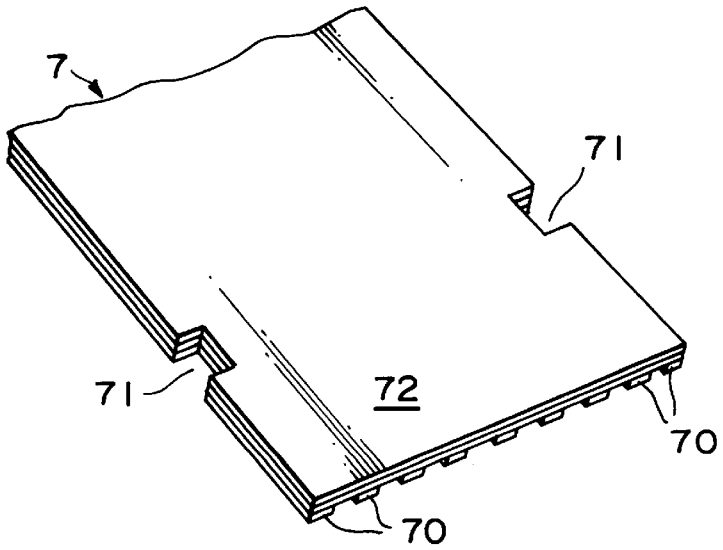
FIG. 6 PRIOR ART
FIG. 6 is a perspective view of one end portion of the flat cable connected to the cable connector member.

The flat cable 7 has signal conductors 70 on a surface and a ground pattern 72 on the other surface thereof, as shown in FIG. 6. The ground pattern 72 covers all over the other surface of the flat cable 7.

Figure 10:
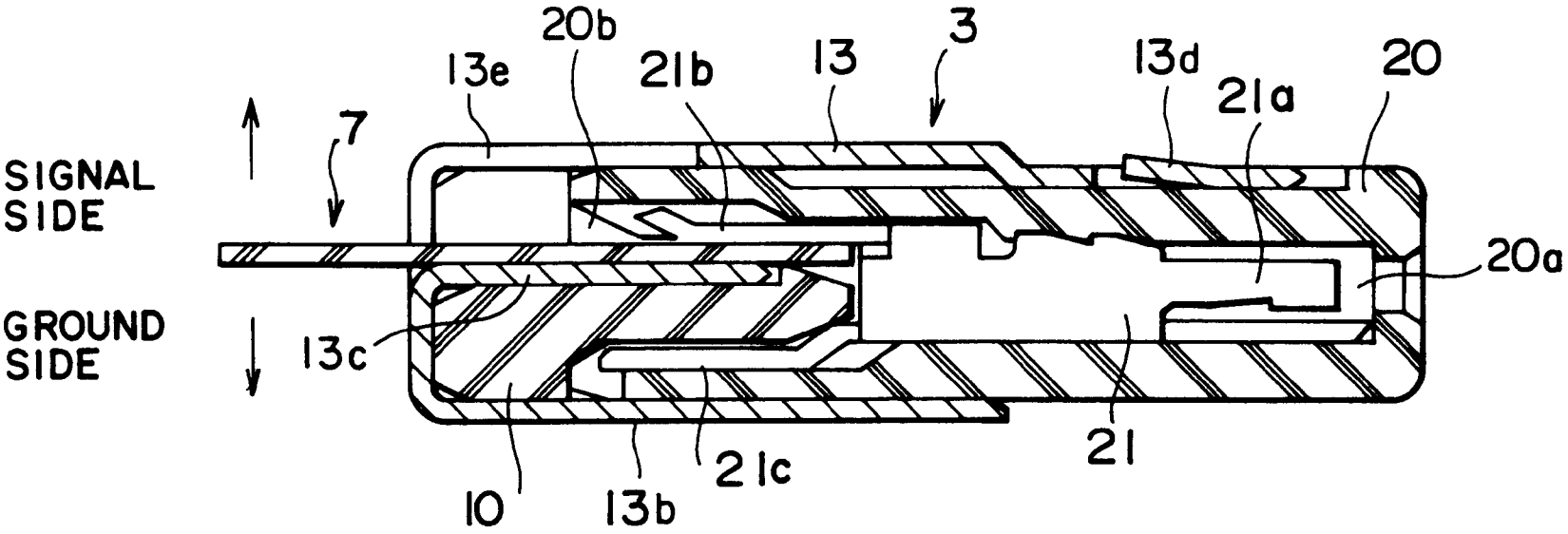
FIG. 10 is a sectional view of the cable connector member in FIGS. 7 through 9 in a state after the cable connector member is connected to the flat cable.
Figure 11A:
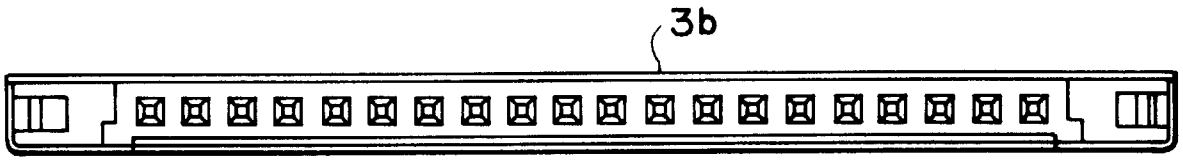
FIG. 11A is a front view of the cable connector member of FIGS. 7 through 10.
Figure 11B:
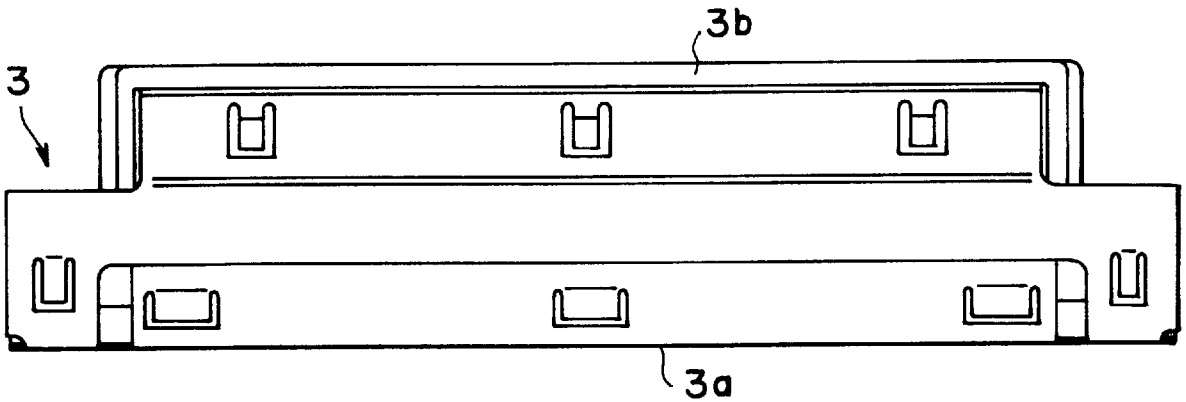
FIG. 11B is a plan view of the cable connector member.
Figure 11C:
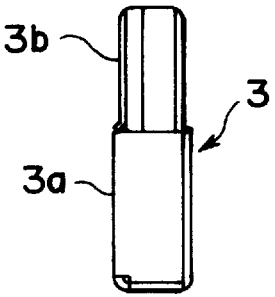
FIG. 11C is a side view of the cable connector member.

Before the flat cable 7 is connected to the cable side connector 3, the cable side shell 13 and the slider 10 are moved to the second position as shown in FIG. 9. Then, the end portion of the flat cable 7 is inserted between the cable contact portion 21*b* and the slider engaging portion 21*c* in the rear opening 20*b* of the cable side insulator 20 through the aperture 13*e* of the cable side shell 13 as the signal conductors 70 being put upwardly. Since there is a sufficient clearance between the slider 10 and the cable contact portion 21*b* at this time, the flat cable 7 can be inserted into the clearance without any resistance. Thereafter, the cable side shell 13 and the slider 10 are moved to the first position as shown in FIG. 10. Thereupon, the cable side shell 13 covers the most part of the circumferential surface of the cable side insulator 20, and the front end portion of the slider 10 is inserted between the flat cable 7 and the slider engaging portion 21*c* in the rear opening 20*b* of the cable side insulator 20. Since the slider 10 presses the flat cable 7 upwardly, the signal conductors 70 of the flat cable 7 are brought into press contact with the cable contact portions 21*b* of the cable side contact elements 21. While, the inner flange 13*c* engages with the ground pattern 72 of the flat cable 7. Consequently, the signal conductors 70 of the flat cable 7 are electrically connected to the cable side contact elements 21. The ground pattern 72 of the flat cable 7 engages with the inner flange 13*c* and is therefore electrically connected to the cable side shell 13.

As shown in FIG. 8, the board side connector 5 comprises a board side insulator 50 as a connector housing, a plurality of board side contact elements 51 and a board side shell 53. The board side insulator 50 has an essentially rectangular parallelepiped shape. The board side connector 5 is surface-mounted on a printed circuit board (not shown).

For connection to the cable side contact elements 21 of the cable side connector 3, the board side contact elements 51 are fixedly mounted in the board side insulator 50 and arranged in parallel with each other so as to correspond to the cable side contact elements 21. Each of the board side contact elements 51 has a contact portion 51*a* of a pin type and a terminal portion 51*b*. The contact portion 51*a* is brought into contact with the contact portion 21*a* of the corresponding one of the cable side contact elements 21. The terminal portion 51*b* is soldered to corresponding one of signal conductors of the printed circuit board.

The board side shell 53 is electrically conductive and is fitted and fixedly mounted onto the board side insulator 50. The board side shell 53 covers the board side insulator 50 and extends to surround the contact portions 51*a* of the contact elements 51 projecting from the board side insulator 50.

When the cable side connector 3 is mated with the board side connector 5, the front end portion of the cable side connector 3 is inserted into the extension of the board side shell 53, while the pin-type contact portions 51*a* is inserted into the front openings 20*a* of the cable side insulator 20. Thus, the board side shell 53 is brought into contact with the deformable portion 13*d* of the cable side shell 13. While, the pin-type contact portions 51*a* are brought into contact with the socket-type contact portions 21*a*. The cable side shell 13 and the board side shell 53 are connected to each other and to the grounded pattern 72 of the flat cable. Therefore, the electro-magnetic shield effect is provided for the socket-type and pin-type contact elements 21 and 51.

As Appreciated from the foregoing description, according to the present invention, the cable side connector has not a plurality of but a single shell so that the following effects or technical merits are obtained.

(1) A two-piece electrical connector having the electromagnetic shielding is realized with a low-profile structure.

(2) Since the number of the parts is reduced, the production cost as well as the number of the assembling steps can be reduced.

(3) Since there is no contact portion in the metallic shell means assembled on the cable side connector, the reliable and safe shielding is insured.

What is claimed is:

1. A two-piece electrical connector comprising a cable connector member to be removably mounted on one end portion of a flat cable to establish mechanical and electrical connections with said flat cable and mating connector member which are to be electrically and mechanically connectored to an associated connection object and to be mated with said cable connector member for establishing an electrical connection between said flat cable and said associated connection object, said flat cable comprising a plurality of signal conductors embedded in an electrical insulator film and partially exposed at one end portion thereof in one surface of said insulator film, wherein said cable connector member comprises:

a first insulator having a rear opening for receiving said one end of said flat cable;

a plurality of first contact elements fixed in said first insulator, said first contact elements individually having first contact portions and first terminal portions disposed in said rear opening;

an insulator slider which is slidably fitted into said rear opening to press said one end portion of said flat cable onto said first terminal portions while it is being inserted together with said one end portion of said flat cable into said rear opening so that said first terminal portions come into a pressed contact with said signal conductors, respectively; and a first metallic shell of a generally box shape having a front open end and fixedly supporting and partially enclosing said insulator slider therein, said metallic shell being fitted onto said first insulator and slidable on said first insulator upon an insertion of said insulator slider into said rear opening;

and wherein said mating connector member comprises:

a second insulator;

a plurality of second contact elements fixedly supported in said second insulator and individually having second contact portions exposed from said second insulator, said second contact portions coming into contact with said first contact portions when said mating connector member is mated with said cable connector member, said second contact elements individually having second terminal portions to be connected to said associated connection object; and a second metallic shell mounted on and covering an outer surface of said second insulator, said second metallic shell being partially fitted onto said cable connector member to come into contact with said first metallic shell when said mating connector member is mated with said cable connector member.

2. The two-piece electrical connector as claimed in claim 1, said flat cable further having a ground pattern formed on a surface of said insulator film which is opposite to said one surface of said insulator film, wherein said first metallic shell is provided with an engaging portion for engaging with said ground pattern of said flat cable.

3. The two-piece electrical connector as claimed in claim 2, wherein said insulator slider comprises an insertion portion to be inserted within said rear opening and a support portion fixedly supported by said first metallic shell, said insulator slider having a flat surface continuous from said insertion portion to said support portion, said first metallic shell having an inner flange portion as said engaging portion extending inwardly therein and on said flat surface of said insulator slider, said first metallic shell having a rear aperture adjacent to said inner flange portion for receiving said one end portion of said flat cable with said ground pattern engaging with said inner flange portion, when said insulator slider is inserted into said rear opening together with said flat cable.

4. A cable connector with metallic shell means and cable fixture means, said metallic shell means being mounted on and covering an outer surface of a connector housing of said cable connector, said connector housing having a rear opening for receiving one end portion of a flat cable, said one end portion being fixedly mounted in said opening by said cable fixture means for establishing electrical and mechanical connection of said cable to said cable connector, said cable connector being matable with a mating connector with gn outer shell, wherein said fixture means is an insulator slider which is slidably fitted into said rear opening together with said one end portion od said flat cable, and wherein said metallic shell means is a box-shaped metallic shell member with a front open end, said metallic shell member fixedly supporting and partially enclosing said insulator slider therein and having a rear aperture for receiving said one end portion of said flat cable therethrough, said metallic shell member being fitted onto said connector housing and slidable on said connector housing so as to insert said insulator slider into said rear opening together with the flat cable.

5. A cable connector as claimed in claim 4, said flat cable having a ground pattern formed on an outer surface, wherein said insulator slider comprises a insertion portion to be inserted within said rear opening and a support portion fixedly supported by said metallic shell member, sid insulator slider having a flat surface continuous from said insertion portion to said support portion, said metallic shell member having an inner flange portion extending inwardly therein from a position close to said rear aperture and on said flat surface of said insulator slider, said inner flange portion coming into engagement with said ground pattern of said flat cable when said one end portion of said flat cable is received in said rear aperture.

* * * * *

UNITED STATES PATENT AND TRADEMARK OFFICE

CERTIFICATE OF CORRECTION

PATENT NO. : 6,066,000
DATED : May 23, 2000
INVENTOR(S) : Toshio Masumoto, Nobukazu Kato It is certified that error appears in the above-identified patent and that said Letters Patent is hereby corrected as shown below:

Column 1, Line 62, delete "complicate" and insert --complicated--

Column 8, Line 18, delete "Appreciated" and insert --appreciated--

Column 10, Line 7, delete "gn" and insert --an--

Column 10, Line 10, delete "od" and insert --of--

Column 10, Line 24, delete "sid" and insert --said--

Signed and Sealed this

Third Day of April, 2001

*Attest:*

Nicholas P. Godici

NICHOLAS P. GODICI

*Attesting Officer*

*Acting Director of the United States Patent and Trademark Office*